US010012460B1

(12) United States Patent
Vankeuren, III

(10) Patent No.: US 10,012,460 B1
(45) Date of Patent: Jul. 3, 2018

(54) GUN CONVERSION KIT

(71) Applicant: Lewis Karl Vankeuren, III, Galena, OH (US)

(72) Inventor: Lewis Karl Vankeuren, III, Galena, OH (US)

( * ) Notice: Subject to any disclaimer, the term of this patent is extended or adjusted under 35 U.S.C. 154(b) by 0 days.

(21) Appl. No.: 15/728,448

(22) Filed: Oct. 9, 2017

(51) Int. Cl.
*F41A 21/48* (2006.01)
*F41A 3/66* (2006.01)
*F41G 11/00* (2006.01)

(52) U.S. Cl.
CPC ..... *F41A 3/66* (2013.01); *F41A 21/48* (2013.01); *F41A 21/482* (2013.01); *F41G 11/003* (2013.01)

(58) Field of Classification Search
CPC ..... F41A 21/48; F41A 21/482; F41A 3/66
See application file for complete search history.

(56) References Cited

U.S. PATENT DOCUMENTS

2012/0137563 A1* 6/2012 Ubl ..... F41A 11/02 42/75.03
2018/0066905 A1* 3/2018 Battaglia ..... F41A 3/66

FOREIGN PATENT DOCUMENTS

DE 2121628 * 11/1972

OTHER PUBLICATIONS

Nordic Components' "AR22 3-Piece 10/22 Stock Kit for Ruger 10/22", <<https://nordiccomp.com/categories/ar22-3-piece-stock-kit-for-ruger-1022/>> Oct. 9, 2017.

* cited by examiner

*Primary Examiner* — Stephen Johnson
(74) *Attorney, Agent, or Firm* — Ronald J Koch

(57) ABSTRACT

A gun conversion kit having upper and lower chassis that fit together on upper and lower surfaces of a 10/22 style receiver. Tactile feedback surfaces facilitate finger positional awareness relative to various receiver parts. A barrel thread and spacer arrangement on the upper chassis allow connection to AR4 style handguards which conveniently align with a picatinny rail integrated into the upper chassis.

3 Claims, 3 Drawing Sheets

GUN CONVERSION KIT

BACKGROUND AND SUMMARY

The Ruger 10/22 is the most popular .22 caliber rifle in the US. The AR-15 is the most popular center fire rifle in the US. Both weapon systems are also among the most commonly modified firearms, with a wide variety of aftermarket products available for both systems.

One of the most common modifications to the 10/22 is the attachment of an accessory rail (e.g. picatinny rail) to the top of the receiver using the four factory-installed screw holes. The rail is oftentimes used to mount a scope.

The most common embodiment of the AR-15 is known as the A4 or Flat Top Profile (AR-15 and A4 are sometimes described generically herein as "AR"). This design has a picatinny rail on the top of the AR-15 upper receiver in place of the carry handle that was present on the original design. This facilitates the mounting of optics on the rifle which was difficult with the original carry handle configuration of the upper receiver.

One of the more common modifications of the AR-15 is the replacement of the handguard. Handguards for the AR-15 are available for a wide variety of specialized applications and the designs often include attachment points for additional accessories such as sighting systems, sling mounts, flashlights, sighting lasers, and bipods. Handguards for the AR-15 are attached by two methods. In the original design, the handguard is captive between brackets attached to the barrel nut and the front sight. The second design is attached using only the barrel nut (generally a specially designed one for the particular handguard, sometimes including a barrel sleeve). These second-type designs are generally considered superior to the original in both simplicity and because the barrel is not contacted by the handguard (i.e. the barrel is "free-floated"), which improves accuracy. The replacement handguards often have a picatinny rail on the top surface that fits flush to and aligns with the picatinny rail on the A4 type AR-15 upper receiver.

Therefore, a system that attaches to the 10/22 like the factory rail/scope mount but that additionally incorporates the barrel nut threads of the AR4 upper receiver allows the wide range of handguards and accompanying accessories available for the AR-15 to be utilized on the 10/22. If the chassis system also incorporated attachment points for AR-15 buffer tubes/stocks and grips, it would allow the similarly wide variety of AR-15 stocks and grips that are available to be utilized on the 10/22 platform.

Other objects and advantages of the subject technology, in addition to such other objects and advantages that may be apparent to those of skill in the art after studying the subject technology, include:

The upper chassis of the subject technology has the same geometry and dimensions as the top and front portion of the AR upper receiver (including the distance from the top of the picatinny rail to the center of the bore, so all free float handguards with upper picatinny rails designed for the AR will align flush and level with the picatinny rail on the upper chassis, and optics and sights designed for the AR will attach and function properly. In one known system (manufactured by Nordic), the upper chassis rail is higher than the handguard rails and there is a horizontal gap between the two.

Removal of the lower chassis of the subject technology for purposes of cleaning or servicing the weapon only requires removal of the single factory takedown screw. Removal of the lower chassis does not require loosening or removal of the top portion of the chassis, so the "zero" of sighting systems is not affected. The other known design requires the picatinny rail to be removed prior to removal of the lower chassis.

The upper chassis of the subject technology has wings that fit onto the barrel block to provide lateral and rotational strength.

The lower chassis has wings that fit over the wings of the upper chassis, providing improved lateral and rotational strength.

Tactile surfaces (aka side cuts) on the lower chassis reduce weight and also provide reference points (tactile feedback) for the trigger, safety, and the bolt release.

The upper chassis of the subject technology can be used without the lower chassis of the subject technology. This aspect allows an AR scope/handguard mount to be used with factory Ruger stocks and aftermarket stocks with only minor modification in that the front portion of the Ruger stocks and aftermarket stocks must be truncated.

In one aspect, the subject technology has only two main parts (upper and lower chassis) as opposed to three (i.e. the upper chassis has an integrated picatinny rail). Conventional systems require removal of the picatinny rail before the lower chassis can be removed.

In one aspect, the subject technology has a retention washer on the takedown screw. A nylon washer fits within a counter bore (aka recess) on the upper surface of a protrusion of the lower chassis (so as to be disposed between the lower chassis and the receiver). A compression washer (aka lock washer) is used on the bottom surface of the lower chassis.

In one aspect, the subject technology incorporates AR-style barrel nut threads that allow attachment of AR-15 free-float handguards, with an additional barrel spacer configured to cause the picatinny rail of an AR4 style handguard to fit properly against the picatinny rail of the subject technology. In other aspects, the barrel spacer ring can be resized (e.g. grinded) to provide a better fit with some handguards without altering the original mount. Thus, replacing the barrel spacer allows use with different handguards.

In one aspect, the upper chassis of the subject technology incorporates the geometry of the top and front portions of an A4 AR-15 upper receiver into a mount with an internal geometry that matches the top and front portions of the Ruger 10/22 receiver. The mount attaches to the 10/22 receiver by utilizing the four factory-installed scope mount holes that are located on the top surface of the 10/22 receiver. The mount closely conforms to the upper surface of the 10/22 receiver and has wings that engage the barrel block. These features provide additional lateral and rotation stability to the chassis/receiver system. Since the exterior dimensions and geometry of the upper chassis match the exterior dimensions and geometry of the AR-15, all free float style handguards designed to attached to the AR-15 utilizing the barrel nut are compatible.

In one aspect, the lower chassis attaches with a single takedown screw located just forward of the magazine well. The lower chassis has AR-style attachment points for the buffer tube/stock and grip, allowing standard AR parts to be utilized (some aftermarket grips may need to be trimmed if dimension differ significantly from the standard AR grip). Lower wings in a front portion of the lower chassis engage wings on the upper chassis to provide additional stability.

In one aspect, the barrel spacer (aka barrel washer) is machined from 6061 aluminum and replaces the collar on the AR barrel allowing for proper fit of free-float handguards. A buffer tube ring maintains proper alignment of the buffer tube/stock during assembly. This is laser cut from steel and pressed into shape. A plastic grip spacer provides a smooth transition between the AR style grips and the 10/22 trigger guard.

REFERENCE NUMERALS IN DRAWINGS

Figure 1:
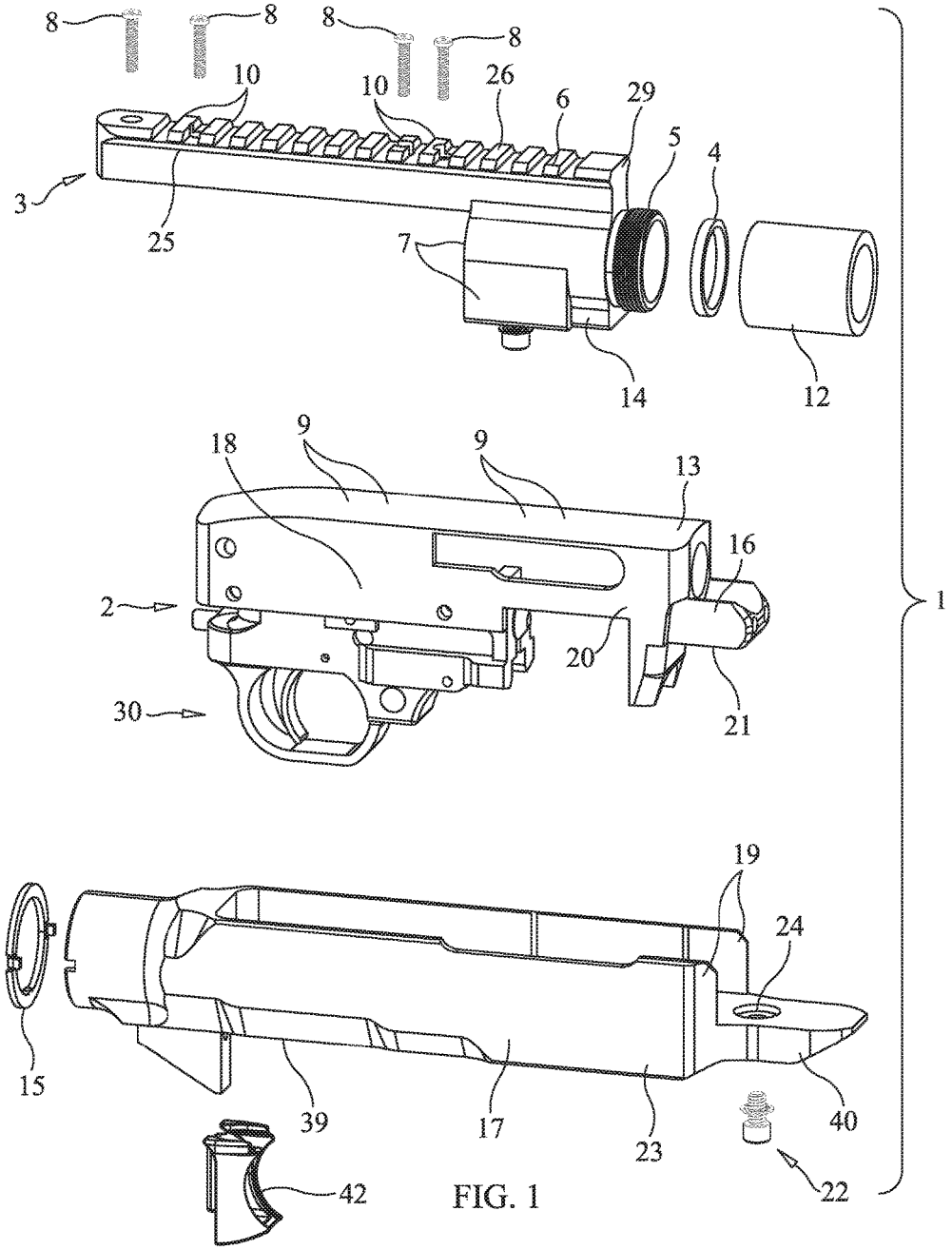
FIG. 1 is an exploded view of the receiver/chassis assembly 1 showing the details of the various components.

The table below lists the reference numerals employed in the figures, and identifies the element designated by each numeral.

1 receiver/chassis assembly 1
2 receiver (e.g. 10/22 receiver) 2
3 upper chassis 3
4 barrel spacer 4
5 barrel nut threads 5
6 picatinny rail 6
7 upper wings 7 of upper chassis 3
8 mounting screws 8
9 receiver mounting holes 9
10 apertures 10 of upper chassis 3
11 barrel 11
12 barrel nut 12
13 top portion 13 of receiver 2
14 front portion 14 of upper chassis 3
15 buffer tube ring 15
16 barrel block 16 of the receiver 2
17 lower chassis 17
18 bottom portion 18 of receiver 2
19 lower wings 19 of lower chassis 17
20 front portion 20 of receiver 2
21 takedown hole 21 of receiver 2
22 takedown screw 22 (aka action screw)
23 front portion 23 of lower chassis 17
24 aperture 24 of lower chassis 17
25 top portion 25 of upper chassis 3
26 top surface 26 of the picatinny rail 6
27 bore 27 of receiver 2
28 bore center 28 of bore 27
29 front surface 29 of upper chassis 3
30 trigger group 30
31 first tapered portion 31 of first tactile surface 32 of lower chassis 17
32 first tactile surface 32
33 second tapered portion 33 of second tactile surface 34 of lower chassis 17
34 second tactile surface 34
35 third tapered portion 35 of third tactile surface 36 of lower chassis 17
36 third tactile surface 36
37 picatinny rail 37 of AR handguard 38
38 AR handguard 38
39 lower portion 39 of lower chassis 17
40 protrusion 40 of lower chassis 17
41 distance 41 distance from top surface 26 of picatinny rail 6 to the center 28 of bore 27
42 grip spacer 42
43 trigger safety 43 of receiver 2
44 trigger 44 of receiver 2
45 location of bolt release lever 45
46 buffer tube 46
47 stock 47
48 grip 48

DETAILED DESCRIPTION

In one aspect, a gun conversion kit comprises, an upper chassis 3 adapted to matingly fit a top portion 13 of a receiver 2; and a lower chassis 17 adapted to matingly fit a bottom portion 18 of the receiver 2.

In one aspect, the lower chassis 17 is removably secured to the bottom portion 18 of the receiver 2 by a single takedown screw 22 disposed through an aperture 24 in a protrusion 40 disposed proximate the front portion 23 of the lower chassis 17. The takedown screw 22 engages a cooperating hole 21 in the bottom portion 18 of the receiver 2. Thus, the lower chassis 17 (possibly with buffer/stock) can be entirely separated from the rest of the weapon with a single screw. This feature is helpful for cleaning, servicing, and/or maintaining the weapon. Other kits require more steps to place the weapon in such a state (e.g. necessary to remove an upper chassis and/or picatinny rail before gaining access to the receiver and magazine well.

Figure 2:
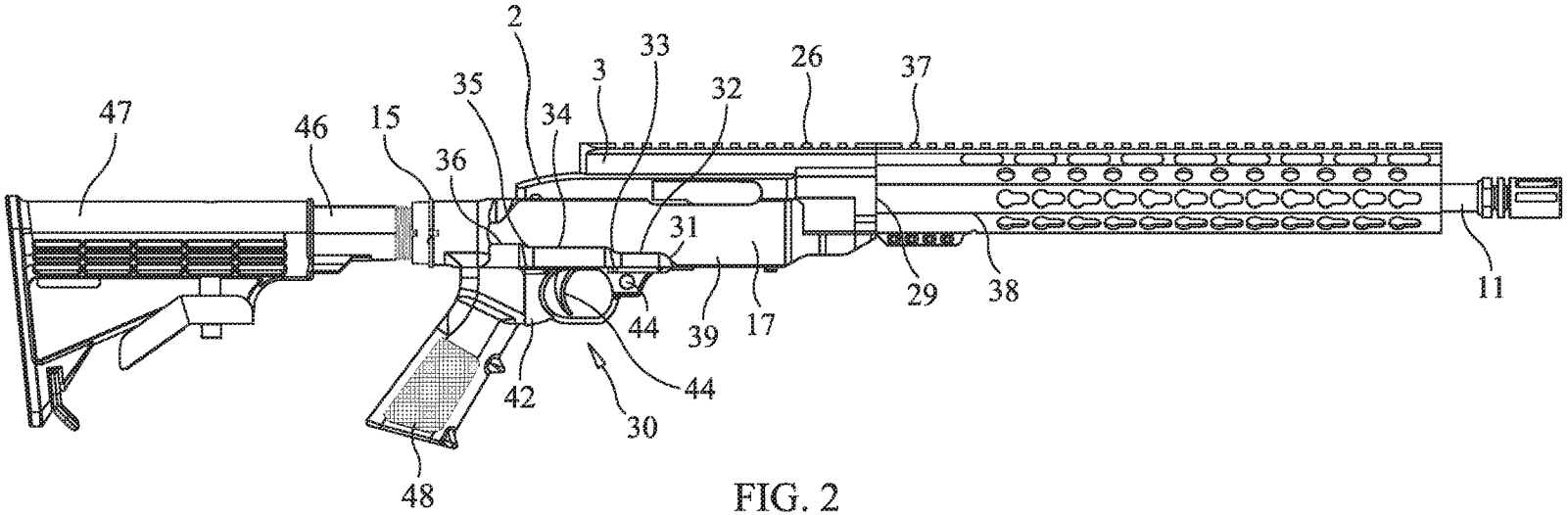
FIG. 2 depicts a side view of one aspect of the subject technology.

As shown in FIG. 1, takedown screw 22 has a compression washer and nylon washer. The nylon washer fits within a counter bore on the upper surface of a protrusion 40 of the lower chassis 17 so as to be disposed between the lower chassis 17 and the receiver 2. A lock washer is used on the bottom surface of the protrusion 40 of the lower chassis 17. As shown in FIG. 2, receiver 2 fits inside of lower chassis 17 such that trigger group 30 is exposed and operational.

In one aspect, the upper chassis 3 is removably connected to the top portion 13 of the receiver 2 via one or more mounting screws 8 disposed through one or more apertures 10 in the upper chassis 3; the mounting screws 8 engaging one or more threaded mounting holes 9 in the top portion 13 of the receiver 2. Mounting screws 8 are disposed through apertures 10 in upper chassis 3 to threadedly engage mounting holes 9 in receiver 2. Apertures 10 in upper chassis 3 are aligned with mounting holes 9 in receiver 2.

In one aspect, the front portion 14 of the upper chassis 3 has barrel nut threads 5 adapted to engage a barrel nut 12. In one aspect, a barrel spacer 4 is disposed axially between the barrel nut threads 5 and a portion of the barrel nut 12. Those of skill in the art will appreciate that a portion of such a barrel nut 12 contains a threaded portion for engaging barrel nut threads 5, and when barrel nut 12 is threadedly engaged to barrel nut threads 5, barrel spacer 4 is axially between barrel nut threads 5 and a portion of barrel nut 12, but the threaded portion of barrel nut 12 is radially outside of barrel spacer 4.

In some aspects, the subject technology incorporates a barrel nut and cooperating barrel sleeve as part of a separately obtained AR handguard kit. An AR handguard is removably attached to either the barrel nut or the barrel sleeve in accordance with the various manufacturer specifications and/or operating manuals.

Buffer tube ring 15 has protrusions that key into slots on the lower chassis 17 and the AR buffer tube 46 to provide proper alignment of the AR stock 47.

In one aspect, top portion 25 of upper chassis 3 has an integrated picatinny rail 6. In one aspect, the receiver 2 is a 10/22 style receiver. The receiver depicted in FIG. 1 is a Ruger 10/22 receiver. Those of skill in the art will appreciate that the dimensions of an AR4 rifle are well known, including the distance from the top of an associated picatinny rail to the center of an associated bore.

Figure 3:
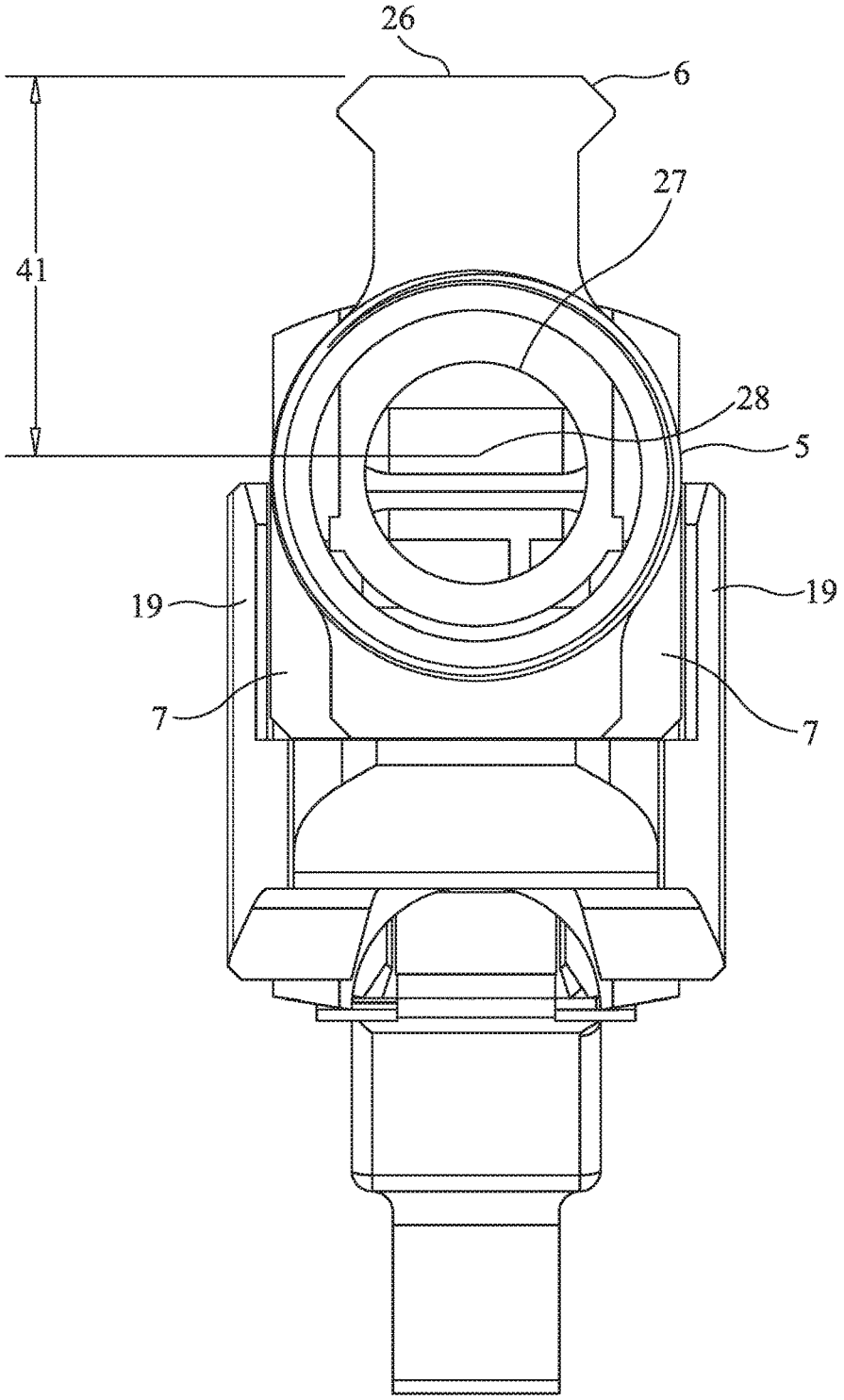
FIG. 3 depicts a front view of one aspect of the subject technology.

In one aspect of the subject technology (FIG. 3), the distance 41 from a top surface 26 of the picatinny rail 6 to the center 28 of a bore 27 of the 10/22 style receiver 2 is configured so that a free-float handguard 38 with upper picatinny rail 37 designed for the AR15 rifle will be axially substantially flush with a front surface 29 of upper chassis 3, and substantially vertically even with the top surface 26 of the picatinny rail 6, as depicted in FIG. 2. In some aspects, barrel spacer 4 (aka barrel washer) provides the necessary offset to allow the barrel nut to fit properly because it takes up the space that would normally be occupied by the ring on an AR barrel.

In one aspect, a front portion 14 of the upper chassis 3 has two upper wings 7 disposed on opposing sides of the upper chassis 3. The two upper wings 7 are adapted to engage opposing sides of a barrel block 16 of the receiver 2. The engagement of upper wings 7 to barrel block 16 is helpful to stabilize the upper chassis 3 relative to the receiver 2. In one aspect, a front portion 23 of the lower chassis 17 has two lower wings 19 disposed on opposing sides of the lower chassis 17.

In one aspect, a portion of the two upper wings 7 of the upper chassis 3 matingly fit inside of a portion of the two lower wings 19. In other words, the upper and lower wings do not completely overlap. The engagement of upper wings 7 fitting inside of lower wings 19 is helpful to stabilize lower chassis 17 relative to upper chassis 3 and receiver 2.

In one aspect, a first tactile surface 32 is disposed in a lower portion 39 of the lower chassis 17. It is to be understood that the word "tactile" as defined herein is defined as a surface characteristic that provides tactile feedback to allow a user to perceive the position his one or more fingers relative to the various parts of the subject technology and accessories. In one aspect, the first tactile surface 32 has a first tapered portion 31.

Those of skill in the art will appreciate that the various tactile surfaces, with or without associated tapered portions, can be associated with various components, including but not limited to trigger, safety, bolt release, and magazine release. In one aspect, first tapered portion 31 is relatively aligned with the location of bolt release 45.

In one aspect, a second tactile surface 34 is disposed in the lower portion 39 of the lower chassis 17 and relatively aligned with the location of the trigger 44. In one aspect, the second tactile surface 34 has a second tapered portion 33. In one aspect (FIG. 2), second tapered portion 33 is relatively aligned with trigger safety 43. In one aspect, the second tactile surface 34 is adjacent to the first tactile surface 32. In one aspect, the first and second tactile surfaces are tiered with respect to each other.

It is to be understood that the word "tiered" as defined herein is defined as the physical relationship between one or more of said tactile surfaces, and associated tapered portions in some aspects, wherein one of said surfaces is laterally offset relative to the other one or more of said surfaces. Thus, one or more of a user's fingers, being in contact with the one or more tactile surfaces and advanced longitudinally (relative to the axial direction of the receiver bore and/or gun barrel) along one or more tiered tactile surfaces, and associated tapered portions, experiences a lateral shift thereby providing tactile feedback to said user.

In one aspect, a third tactile surface 36 is disposed in the lower portion 39 of the lower chassis 17. In one aspect, the third tactile surface 36 has a third tapered portion 35. In one aspect (FIG. 2), third tapered portion 35 is relatively aligned with trigger 44. In one aspect, the third tactile surface 36 is adjacent to the second tactile surface 34, and the second tactile surface 34 is disposed intermediate the first and third tactile surfaces 32, 36. In one aspect, the first, second, and third tactile surfaces 32, 34, 36 are tiered with respect to each other.

In one aspect, a grip spacer 42 provides a smooth transition between the AR-style grip 48 and the 10/22 trigger group 30.

In some aspects of the subject technology, use with AR15 compatible handguards are contemplated. However, it should be noted that the subject technology can be sized commensurate with other handguards, including AR compatible handguards.

It should be understood that, although in one or more aspects the subject technology is configured to fit a Ruger 10/22 receiver (including trigger housing), the subject technology can be adapted to fit other receivers in an analogous manner.

The invention is in no way limited to the specifics of any particular embodiments and examples disclosed herein. For example, the terms "aspect," "example," "preferably," "alternatively," and the like denote features that may be preferable but not essential to include in some embodiments of the invention. In addition, details illustrated or disclosed with respect to any one aspect of the invention may be used with other aspects of the invention. Additional elements and/or steps may be added to various aspects of the invention and/or some disclosed elements and/or steps may be subtracted from various aspects of the invention without departing from the scope of the invention. Singular elements/steps imply plural elements/steps and vice versa. Some steps may be performed serially, in parallel, in a pipelined manner, or in different orders than disclosed herein. Many other variations are possible which remain within the content, scope, and spirit of the invention, and these variations would become clear to those skilled in the art after perusal of this application.

What is claimed is:

1. A gun conversion kit comprising:

an upper chassis adapted to matingly fit a top portion of a receiver;

a lower chassis adapted to matingly fit a bottom portion of the receiver;

the lower chassis being removably secured to the bottom portion of the receiver by a takedown screw disposed through an aperture in a protrusion disposed proximate a front portion of the lower chassis, the takedown screw engaging a cooperating hole in the bottom portion of the receiver;

a front portion of the upper chassis having barrel nut threads adapted to threadedly engage a barrel nut.

2. The gun conversion kit of claim 1 further comprising:

a barrel spacer disposed axially between the barrel nut threads and a portion of the barrel nut;

said top portion of the upper chassis having an integrated picatinny rail.

3. The gun conversion kit of claim 2 further comprising:

a distance from a top surface of the picatinny rail to a center of a bore of the 10/22 receiver being configured so that a free-float handguard with a second upper picatinny rail will be axially substantially flush with a front surface of the upper chassis, and vertically even with the top surface of the integrated picatinny rail.

* * * * *